US012134736B2

(12) United States Patent
Igawa et al.

(10) Patent No.: US 12,134,736 B2
(45) **Date of Patent: *Nov. 5, 2024**

(54) METHOD OF PRODUCING COAL BLEND AND METHOD OF PRODUCING COKE

(71) Applicant: JFE Steel Corporation, Tokyo (JP)

(72) Inventors: Daisuke Igawa, Tokyo (JP); Takashi Matsui, Tokyo (JP); Yusuke Dohi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 127 days.

This patent is subject to a terminal disclaimer.

(21) Appl. No.: 17/789,705

(22) PCT Filed: Dec. 25, 2020

(86) PCT No.: PCT/JP2020/048673
§ 371 (c)(1),
(2) Date: Jun. 28, 2022

(87) PCT Pub. No.: WO2021/140947
PCT Pub. Date: Jul. 15, 2021

(65) Prior Publication Data

US 2023/0051325 A1 Feb. 16, 2023

(30) Foreign Application Priority Data

Jan. 7, 2020 (JP) ..... 2020-000716

(51) Int. Cl.
*C10B 57/04* (2006.01)
*C10L 5/04* (2006.01)

(52) U.S. Cl.
CPC ..... *C10B 57/04* (2013.01); *C10L 5/04* (2013.01); *C10L 2290/60* (2013.01)

(58) Field of Classification Search
CPC ..... C10B 57/04; C10L 5/04; C10L 2290/60
See application file for complete search history.

(56) References Cited

U.S. PATENT DOCUMENTS 4,135,983 A * 1/1979 Kiritani ..... C10B 55/02 208/22
9,463,980 B2 * 10/2016 Fukada ..... G01N 33/222
(Continued)

FOREIGN PATENT DOCUMENTS

CN 102491307 A 6/2012
EP 2 767 574 A1 8/2014
(Continued)

OTHER PUBLICATIONS

Office Action dated Feb. 21, 2023, of counterpart Russian Patent Application No. 2022118261, along with an English translation.
(Continued)

*Primary Examiner* — Jonathan Miller
(74) *Attorney, Agent, or Firm* — DLA Piper LLP (US)

(57) ABSTRACT

A method of producing a coal blend by blending plural brands of coal to produce a coal blend includes letting a surface tension of coal when inert material is assumed to be 100 vol % be $\gamma_{100}$, and letting a surface tension of coal when reactive material is assumed to be 100 vol % be $\gamma_0$, determining $\gamma_0$ of coal; among brands of coal 1, 2, . . . i, . . . , and n to be blended in a coal blend, specifying coal i in which $\gamma_{100}$ is outside of $\gamma_0$; measuring TI of coal i; and determining a blending ratio of coal i such that w calculated by formula (1) is 20.4 mass % or less $$w=\Sigma(xi\times TIi) \quad (1).$$

8 Claims, 2 Drawing Sheets

(56) References Cited

U.S. PATENT DOCUMENTS

| | | | | |
|---|---|---|---|---|
| 9,850,441 | B2 * | 12/2017 | Fukada | G01N 33/222 |
| 10,144,891 | B2 * | 12/2018 | Shimoyama | C10B 57/04 |
| 2013/0255142 | A1 * | 10/2013 | Dohi | C10B 57/06 44/550 |
| 2015/0039242 | A1 | 2/2015 | Fukada et al. | |
| 2015/0040468 | A1 * | 2/2015 | Shimoyama | C10L 5/04 44/620 |
| 2015/0047961 | A1 * | 2/2015 | Fukada | C10B 57/04 201/1 |
| 2015/0075961 | A1 * | 3/2015 | Fukada | G01N 13/00 44/620 |
| 2015/0075962 | A1 | 3/2015 | Shimoyama et al. | |
| 2022/0163501 | A1 | 5/2022 | Igawa et al. | |

FOREIGN PATENT DOCUMENTS

| | | | |
|---|---|---|---|
| EP | 2 985 602 | A1 | 2/2016 |
| JP | 59-10659 | B2 | 11/2014 |
| JP | 5737473 | B2 | 6/2015 |
| JP | 2015-232125 | A | 12/2015 |
| KR | 10-2012-0043950 | A | 5/2012 |
| RU | 2640183 | C2 | 12/2017 |
| TW | 201319239 | A | 5/2013 |
| WO | 2013/145677 | A1 | 10/2013 |
| WO | 2013/145678 | A1 | 10/2013 |
| WO | 2013/145679 | A1 | 10/2013 |
| WO | 2020/179576 | A1 | 9/2020 |

OTHER PUBLICATIONS

Office Action dated Aug. 4, 2021, of counterpart Taiwanese Patent Application No. 110100044, along with a Concise Explanation of Relevance of the Office Action in English.

International Search Report dated Mar. 16, 2021, of corresponding International Application No. PCT/JP2020/048673, along with an English translation.

Williams, M.C. & Fuerstenau, D.W., "A Simple Flotation Method for Rapidly Assessing the Hydrophobicity of Coal Particles," *International Journal of Mineral Processing*, 1987, vol. 20, p. 153.

Examination Report No. 1 dated May 24, 2023, of counterpart Australian Patent Application No. 2020421315.

First Office Action dated Oct. 27, 2023, of counterpart Chinese Patent Application No. 202080091158.8, along with a Concise Explanation of Relevance of the Office Action in English.

D. Zhang et al., "Study on Vitrinite Characteristics of Coking Coals with Similar Coalification Degrees," *Fuel & Chemical Processes*, vol. 46 (5), Sep. 30, 2015, along with an English machine translation.

Extended European Search Report dated Apr. 28, 2023, of counterpart European Patent Application No. 20911622.7.

Nagayama et al., "Evaluation of Coal Compatibility Effect in Coke Strength by Surface Tension of Semi-coke," ISIJ International, vol. 57, No. 6, pp. 989-995, 2017.

Official Action dated Dec. 15, 2023, of related U.S. Appl. No. 17/770,354.

* cited by examiner

METHOD OF PRODUCING COAL BLEND AND METHOD OF PRODUCING COKE

TECHNICAL FIELD

This disclosure relates to a method of producing coal blend that can be used to produce high-strength coke, and a method of producing coke.

BACKGROUND

Coke used as a blast furnace raw material to produce pig-iron in a blast furnace preferably has high strength. If coke has low strength, the coke is degraded in a blast furnace, thereby impairing the permeability of the blast furnace. Consequently, pig-iron cannot be produced consistently.

Typically, coke is produced by carbonizing a coal blend prepared by blending together plural types of coal in a coke oven. Various methods are known as methods of blending coal to obtain coke having a desired strength. Japanese Patent No. 5737473 discloses a method of blending coal in consideration of coal compatibility using, as an index, the surface tension of semicoke obtained by heat-treating coal.

The term "coal compatibility" refers to a property in which the plural brands of coal in a coal blend interact with one another. In some instances, depending on the coal compatibility, an additive property is not valid for the strength of coke derived from the respective types of coal of a coal blend and the strength of coke derived from the coal blend. In Japanese Patent No. 5737473, the coal blending ratio is adjusted using the value of the interfacial tension as an index, the interfacial tension being calculated from the surface tensions of the semicoke produced by heat-treating each of the brands of coal contained in the coal blend and the blending ratio (mass %) of each brand of coal in the coal blend.

In recent years, from the standpoint of ensuring consistent procurement of coal resources and reducing the raw material cost, it has been increasingly necessary to purchase coal mined at more than one location and use the plural brands of coal having different properties, as raw materials of a coal blend. Even when several types of coal having different properties are to be used in a coal blend, the method disclosed in Japanese Patent No. 5737473 can be employed to prepare a coal blend from which coke having a desired strength is expected to be produced. However, there is a problem that, depending on the coal, coke that does not have high strength is produced even if plural brands of coal are blended at the mass ratio determined by the method proposed in Japanese Patent No. 5737473.

It could therefore be helpful to provide a method of producing a coal blend that can produce coke having high strength after carbonization, and a method of producing coke.

SUMMARY

We thus provide:

[1] A method of producing a coal blend by blending plural brands of coal to produce a coal blend includes letting a surface tension of coal when inert material is assumed to be 100 vol % be $\gamma_{100}$, and letting a surface tension of coal when reactive material is assumed to be 100 vol % be $\gamma_0$, determining a range of $\gamma_0$ of coal; among brands of coal 1, 2, . . . i, . . . , and n to be blended in a coal blend, specifying coal i in which $\gamma_{100}$ is outside a range of $\gamma_0$; measuring TI of coal i; and determining a blending ratio of coal i such that w calculated by formula (1) is 20.4 mass % or less, $$w=\Sigma(xi\times TIi) \quad (1)$$

wherein xi is the blending ratio (mass %) of coal i, TIi is a fraction (vol %) of inert material contained in coal i, and w is a mass fraction (mass %) of the inert material of the coal outside the range of $\gamma_0$ in the coal blend.

[2] The method of producing a coal blend described in [1], wherein, when the surface tension is measured using semicoke produced by heat-treating coal at a temperature T° C. of 350° C. to 800° C., $\gamma_0$ is (0.055 T+10.4) mN/m or more and (0.041 T+22.0) mN/m or less.

[3] The method of producing a coal blend described in [1], wherein, when the surface tension is measured using semicoke produced by heat-treating coal at 500° C., $\gamma_0$ is 37.9 mN/m or more and 42.5 mN/m or less.

[4] A method of producing coke includes producing coke by carbonizing a coal blend produced by the method of producing a coal blend described in any of [1] to [3].

By implementing our method of producing a coal blend, it is possible to produce a coal blend from which high-strength coke is produced after carbonization. The coal blend can be carbonized in a coke oven to produce high-strength coke.

DETAILED DESCRIPTION

Figure 1:
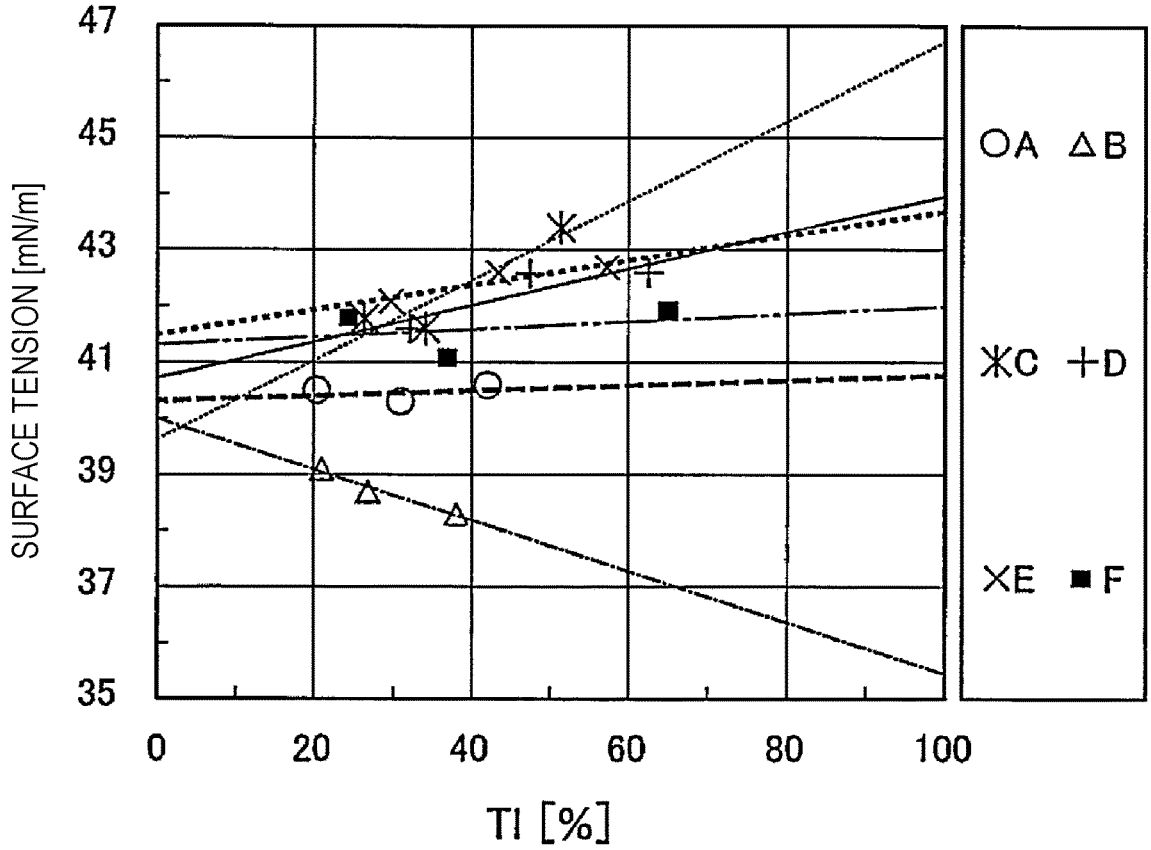
FIG. 1 is a graph showing plots of measured surface tension values (three points) for each of six brands of coal (A to F) and the regression lines for the plots.

Our methods will be described below through the examples. In our method of producing a coal blend, we focused on components of coal that soften when heated ("reactive material") and components that do not soften when heated ("inert material"). A coal blend is produced by blending coal such that the mass fraction of the inert material of coal that may reduce the coke strength is less than or equal to a predetermined fraction. The coal blend produced in this way can be carbonized in a coke oven to produce high-strength coke.

In the method of producing a coal blend, plural brands of coal are blended such that the mass fraction w (mass %) of the inert material outside the range of the surface tension of the reactive material calculated by formula (1) in the coal blend is 20.4 mass % or less $$w=\Sigma(xi\times TIi) \quad (1).$$

Letting the surface tension of inert material when the inert material is 100 vol % be $\gamma_{100}$, and letting the surface tension of reactive material when the reactive material is 100 vol % be $\gamma_0$, in formula (1) above, among coals 1, 2, . . . i, . . . , and n in the coal blend, xi is the blending ratio (mass %) of coal i in which $\gamma_{100}$ is outside of $\gamma_0$, and TIi is the ratio (vol %) of the inert material contained in coal i.

The surface tension $\gamma_{100}$ of the inert material when the inert material is assumed to be 100 vol % and the surface tension $\gamma_0$ of the reactive material when the reactive material is 100 vol % can be estimated from the surface tensions of semicokes obtained by preparing samples having different inert material amounts from the same brand of coal and heat-treating these samples at a predetermined temperature.

The inert material of coal is harder than reactive material. Thus, inert material tends to be concentrated on the part of coarse particles of coal after pulverization. Using this tendency, samples having different inert material amounts can be prepared from the same brand of coal by separating coal after pulverization into particles having larger particle sizes and particles having smaller particle sizes by a known classification method. For example, when using a sifting operation as the classification method, when a certain brand of coal that has been pulverized is sifted through a sieve having a certain mesh size, the inert material amount in the coarse particles plus the sieve is larger than the inert material amount in the fine particles minus the sieve. In each of the samples having different inert material amounts prepared in this way, the total inert material was measured. Each sample was then heat-treated at a predetermined temperature to produce semicoke. TI is the total inert material specified in JIS M 8816 and indicates the proportion (vol %) of inert material contained in coal. As a method of preparing samples having different inert material amounts from the same brand of coal, a method of subjecting pulverized coal to specific gravity separation may be employed. Typically, particles having a high inert material amount have a high specific gravity. Thus, when coal is fed into a liquid having a certain specific gravity, the inert material amount of floating particles having a small specific gravity is low, whereas the inert material amount of settling particles having a large specific gravity is high.

A method of preparing semicoke used to measure the surface tension of coal and a method of measuring the surface tension of coal will be described. Semicoke is a heat-treated product obtained by heat-treating coal. When the expression "surface tension of coal" is described, the coal includes not only coal but also heat-treated coal. Similarly, when the expression "surface tension of inert material" is described, the inert material also includes the inert material of heat-treated coal, and when the expression "surface tension of reactive material" is described, the reactive material also includes the reactive material of heat-treated coal. The surface tension of semicoke is particularly useful in predicting coke strength and producing high-strength coke. Thus, in this example, using the surface tension of semicoke, which is heat-treated coal, will be described. In this example, semicoke is produced by (a) to (c) below.

(a) Coal is pulverized. From the viewpoint of preparing a uniform sample from coal that is non-uniform in microstructure, properties and so forth, coal is preferably pulverized to a particle size of 250 μm or less, which is the pulverization particle size in the proximate analysis of coal described in JIS M8812, more preferably a particle size of 200 μm or less.

(b) The pulverized coal is heated to 500° C. at a suitable heating rate, either with the air cut off or in an inert gas. The heating rate is preferably determined depending on a heating rate at which coke is produced in a coke oven.

(c) Heated coal is cooled in an inert gas to produce semicoke.

Based on the idea that surface tension affects the adhesion between coal particles, the appropriate heating temperature for heating coal is considered to be any temperature from 350° C. or higher, at which coal begins to soften, to 800° C., at which coking is complete. However, in the heating temperature of 350° C. to 800° C., the temperature that particularly contributes to adhesion is a temperature of 350° C. to 550° C., which is a temperature at which softening occurs, and it is believed that an adhesion structure is determined at about 500° C. For this reason, the heating temperature is particularly preferably 480° C. to 520° C., which is near 500° C., and the heating temperature is set to 500° C. in this example. The heating is preferably performed in an atmosphere of an inert gas (e.g., nitrogen, argon, or helium) that does not react with coal. The value of the surface tension measured varies depending on the heating temperature at which the semicoke is prepared. Thus, the heating in preparing semicoke from coal used to blend is preferably performed under the same conditions for all coals. In particular, the maximum heat treatment temperature is particularly preferably within a predetermined temperature±10° C.

The cooling is preferably performed in an inert gas atmosphere that does not react with coal. The coal after the heat treatment is preferably quenched at a cooling rate of 10° C./sec or more. A reason for the quenching is to maintain the molecular structure achieved in the plastic state, and thus the cooling is preferably performed at a cooling rate of 10° C./sec or more, at which it is believed that the molecular structure does not change. The quenching may be performed using ice water, water, liquid nitrogen, or an inert gas such as nitrogen gas. The quenching is preferably performed using liquid nitrogen.

The surface tension of coal can be measured by a film flotation method described in D. W. Fuerstenau: International Journal of Mineral Processing, 20(1987), 153. That method can be employed for both coal and semicoke derived from the coal in a similar manner. A distribution of surface tensions of finely pulverized coal sample was determined by using a film flotation method. A mean value in the obtained distribution of surface tensions was designated as a representative value of the surface tensions of the coal sample.

The measurement of surface tension by the film flotation method is preferably performed as described below. A liquid used in the film flotation method is a liquid having a surface tension of 20 to 73 mN/m, which is the range of the surface tension distribution of coals or softened coals. For example, a liquid having a surface tension of 20 to 73 mN/m can be prepared from an aqueous solution of an organic solvent such as ethanol, methanol, propanol, tert-butanol, or acetone. Regarding the particle size of the sample to be measured for the surface tension, it is preferable to measure the surface tension when the contact angle is approximately equal to 0° based on the measurement principle. A smaller particle size is preferred because the contact angle increases as the particle size of the pulverized sample particles increases. However, when the sample particles have a particle size of less than 53 μm, the particles aggregate easily. Thus, the sample particles are preferably pulverized to a particle size of 53 to 150 μm. The surface tension distribution of a sample can be determined by allowing sample particles to fall onto liquids having various surface tensions, determining the mass fraction of sample particles floating on each liquid, and plotting the results as a frequency distribution curve.

FIG. 1 is a graph showing plots of surface tensions (three points) of samples having different inert material amounts for each of six brands of coal (A to F) and the regression lines for the plots. In FIG. 1, the horizontal axis represents TI (vol %), and the vertical axis represents the surface tension (mN/m). As shown in FIG. 1, a roughly linear relationship was observed between TI and the surface tension of semicoke for each brand of coal. The results indicate that the surface tension $\gamma_{100}$ of the inert material and the surface tension $\gamma_0$ of the reactive material can be estimated by determining the regression line from the plots of the surface tensions of the multiple samples having different inert material amounts for each brand of coal contained in the coal blend and determining a value ($\gamma_{100}$) corresponding to TI=100 when the inert material is 100 vol % (the reactive material is 0 vol %) and a value ($\gamma_0$) corresponding to TI=0 when the reactive material is 100 vol % (the inert material is 0 vol %) in the regression line.

As shown in FIG. 1, $\gamma_0$ converged to a certain range regardless of the brand of coal, whereas $\gamma_{100}$ varied greatly in accordance with the brand of coal. This indicates that the reason why the surface tension varies depending on the brand of coal is that $\gamma_{100}$ varies from coal to coal. FIG. 1 indicates that some coals such as coal B and coal C, have significantly different $\gamma_{100}$ and $\gamma_0$, whereas some coals such as coal A and coal F, have almost the same $\gamma_{100}$ and $\gamma_0$. In Japanese Patent No. 5737473, $\gamma_{100}$ and $\gamma_0$, which affect the surface tension of coal, are not taken into consideration. For this reason, coke that does not have high strength may be produced even if plural brands of coal are blended in a mass ratio determined by the method suggested in Japanese Patent No. 5737473. According to conventional knowledge, it has not been known that the surface tension of semicoke obtained by heat-treating coal macerals varies in accordance with the macerals. We discovered that there are differences in surface tension according to the macerals.

The conditions for producing a coal blend that can produce coke having high strength will be described below. Coal is softened by heating during carbonization, causing the particles to adhere together and then contract. The contraction rate depends on coal and also on coal macerals. Thus, for example, in a coal blend composed of two types of coal having different contraction rates, cracking occurs at the adhesive interfaces of the coals in the process of producing coke due to the difference in contraction rate. When the adhesive strength at the interface between the coals is weak, number of cracks increases, and these cracks reduce the coke strength. Thus, high-strength coke cannot be produced from a coal blend that contains coal having weak adhesive strength. The surface tension of semicoke affects this adhesive strength. A larger difference in surface tension between particles results in a smaller adhesive strength. As described above, the difference in surface tension among brands of coal is due to the fact that different coals have different $\gamma_{100}$. Thus, the coal having $\gamma_{100}$ within $\gamma_0$ has a small difference in surface tension between pieces of coal and between the macerals, and does not decrease the coke strength. In contrast, coal having $\gamma_{100}$ outside of $\gamma_0$ has a large difference in surface tension between pieces of coal and even within the same piece of coal, resulting in a decrease in coke strength.

Thus, we focused on inert material in coal that reduces coke strength and examined whether it is possible to use the mass fraction of the inert material in the coal having $\gamma_{100}$ outside of $\gamma_0$ for the production conditions of a coal blend that can produce high-strength coke. Table 1 presents the properties of coal G to N used for the examination. Table 2 presents the properties of coal blends 1 to 4 with coal G to N in predetermined mass ratios.

TABLE 1

| Brand | logMF (log/ddpm) | Ro (%) | TI (vol %) | Surface tension (mN/m) | Surface tension of inert material $\gamma_{100}$ (mN/m) | Surface tension of reactive material $\gamma_0$ (mN/m) |
|---|---|---|---|---|---|---|
| G | 2.43 | 1.00 | 40.0 | 41.3 | 44.5 | 39.2 |
| H | 2.48 | 1.24 | 43.0 | 39.3 | 41.2 | 38.5 |
| I | 0.48 | 0.99 | 30.0 | 41.3 | 44.7 | 39.9 |
| J | 1.79 | 0.97 | 35.4 | 40.2 | 44.9 | 38.6 |
| K | 0.85 | 1.54 | 21.4 | 38.7 | 37.1 | 39.1 |
| L | 3.47 | 0.64 | 21.8 | 41.6 | 49.4 | 39.4 |
| M | 2.85 | 1.18 | 35.8 | 39.8 | 42.0 | 38.6 |
| N | 2.65 | 1.17 | 43.0 | 39.8 | 42.1 | 38.3 |

TABLE 2

| Brand | | Coal blend 1 | Coal blend 2 | Coal blend 3 | Coal blend 4 |
|---|---|---|---|---|---|
| G | (mass %) | 30.0 | 20.0 | 10.0 | 0.0 |
| H | | 0.0 | 10.0 | 20.0 | 30.0 |
| I | | 16.0 | 16.7 | 17.3 | 18.0 |
| J | | 20.0 | 21.7 | 23.4 | 25.0 |
| K | | 2.9 | 2.3 | 1.7 | 1.1 |
| L | | 5.8 | 8.8 | 11.9 | 14.9 |
| M | | 13.3 | 8.9 | 4.4 | 0.0 |
| N | | 12.0 | 11.6 | 11.3 | 11.0 |
| logMF | (log/ddpm) | 2.09 | 2.09 | 2.09 | 2.10 |
| Ro | (%) | 1.03 | 1.03 | 1.03 | 1.03 |
| TI | (vol %) | 35.7 | 35.6 | 35.5 | 35.4 |
| DI150/15 | (—) | 78.2 | 80.2 | 82.0 | 82.0 |
| w | (mass %) | 25.8 | 23.1 | 20.4 | 17.7 |

In Tables 1 and 2, "log MF (log/ddpm)" is the common logarithm of a maximum fluidity (MF) of coal as measured by the Gieseler plastometer method described in JIS M 8801. The maximum fluidity log MF of a coal blend is a weighted average of the logs MF of the respective brands of coal in the coal blend. In Tables 1 and 2, "Ro (%)" is the mean maximum reflectance of vitrinite in coal or a coal blend according to JIS M 8816. In Tables 1 and 2, "TI (vol %)" is total inert material calculated by methods of microscopical measurement for the macerals of coal or a coal blend according to JIS M 8816 and formula (2) below, which is based on the Parr Formula described in an explanation of the methods. TI in a coal blend was calculated by integrating values obtained by multiplying TI of each brand of coal contained in the coal blend by the blending ratio of the coal.

$$\text{Inert amount (vol \%)} = \text{fusinite (vol \%)} + \text{micrinite (vol \%)} + (2/3) \times \text{semifusinite (vol \%)} + \text{mineral matter (vol \%)} \quad (2)$$

In this example, the effect of a component that adversely affects coke strength is quantitatively evaluated by using the mass fraction of the inert material of coal in which $\gamma_{100}$ is outside of $\gamma_0$. TI obtained by the JIS method is a value of vol %. Thus, it is preferable to convert vol % into mass % for accuracy. However, the TI component and other components have the same density, and a practically sufficient effect is provided. Thus, the TI value obtained in units of vol % is used as a value in units of mass % of the inert material of the coal. In the description of this example, as a value of TI in units of mass %, a value in units of vol % obtained by the JIS measurement methods is used.

"Surface tension (mN/m)" in Table 1 is the surface tension, measured by the film flotation method, of semicoke prepared by heat treatment at 500° C. "Surface tension of inert material $\gamma_{100}$ (mN/m)" and "Surface tension of reactive material $\gamma_0$ (mN/m)" in Table 1 were obtained as follows. Three types of samples having different inert material amounts were prepared from the same brand of coal by pulverization and sifting. A regression line was obtained from the surface tensions of the three types of samples. A value corresponding to TI=100 in the regression line was denoted as $\gamma_{100}$, and a value corresponding to TI=0 was denoted as $\gamma_0$.

Table 1 presents examples of coal commonly used as a raw material for coke. In coal used as a raw material for coke, MF is 0 to 60,000 ddpm (log MF is 4.8 or less), Ro is 0.6% to 1.8%, and TI is 3 to 50 vol %. The method of producing a coal blend can be particularly suitably employed for coal in this range. The properties of coal in Table 1 are as follows: log MF is 0.48 to 3.47, Ro is 0.64% to 1.54%, and TI is 21.4 vol % to 43.0 vol %. However, application of our methods is not limited to coal in this range. Our techniques are also applicable even if additives other than coal are contained.

"DI 150/15" in Table 2 is a strength index of coke obtained by carbonization of coal (coal blend) and is drum strength DI (150/15), which is an index obtained by measuring a mass fraction of coke having a particle size of 15 mm or more after a drum tester charged with a predetermined amount of coke is rotated 150 times at 15 rpm based on a rotational strength test method of JIS K 2151 and multiplying the mass ratio before rotation by 100. In Table 2, w is a mass fraction of inert material outside the surface tension $\gamma_0$ of reactive material, and was calculated using formula (1)

$$w=\Sigma(xi\times TIi) \quad (1).$$

In formula (1), xi is the blending ratio (mass %) of coal i in which $\gamma_{100}$ is outside the surface tension $\gamma_0$ of reactive material among brands of coal 1, 2, . . . i, . . . , and n in the coal blend. TIi is TI of coal i, and w is the mass fraction of inert material outside the surface tension $\gamma_0$ of reactive material. The surface tension $\gamma_0$ of the reactive material may be limited to the plural brands of coal contained in the coal blend, or may be determined as the $\gamma_0$ of semicoke obtained by analyzing not only the plural brands of coal contained in the coal blend but also a large number of coals. For example, $\gamma_0$ of semicoke is determined for all coals for coke production held as stocks in a coke plant. The range between the maximum and minimum values thereof is defined as the surface tension $\gamma_0$ of reactive material. Accordingly, our method of producing a coal blend can be employed not only to the coal contained in the coal blend but also to coal used as a raw material for coke.

When the tests presented in Tables 1 and 2 were conducted, $\gamma_0$ of semicoke obtained by heat-treating, at 500° C., not only coals G to N but also all the coals held as stocks was 37.9 mN/m at minimum and 42.5 mN/m at maximum. Accordingly, the surface tension $\gamma_0$ of the reactive material in this example is set to 37.9 mN/m or more and 42.5 mN/m or less in terms of the value of the semicoke obtained by the heat treatment at 500° C. Thus, among coals G to N presented in Table 1, coals each having the inert material outside the surface tension $\gamma_0$ of the reactive material are coals G, I, J, K, and L.

To calculate w, the mass fraction of inert material in coal outside the surface tension $\gamma_0$ of reactive material among coals in the coal blend was calculated by multiplying each of the blending ratios of coals G, I, J, K, and L, which are coals each having inert material outside the surface tension $\gamma_0$ of reactive material, by TI of a corresponding one of the coals and summing them. For example, in coal blend 1, the mass fraction of the inert material in coal G is 0.300×0.400×100=12.0 mass %. The mass fraction of the inert material in coal I is 0.160×0.300×100=4.8 mass %. The mass fraction of the inert material in coal J is 0.200×0.354×100=7.1 mass %. The mass fraction of the inert material in coal K is 0.029×0.214×100=0.6 mass %. The mass fraction of the inert material in coal L is 0.058×0.218×100=1.3 mass %. By summing these, w=25.8 mass % is calculated.

Figure 2:
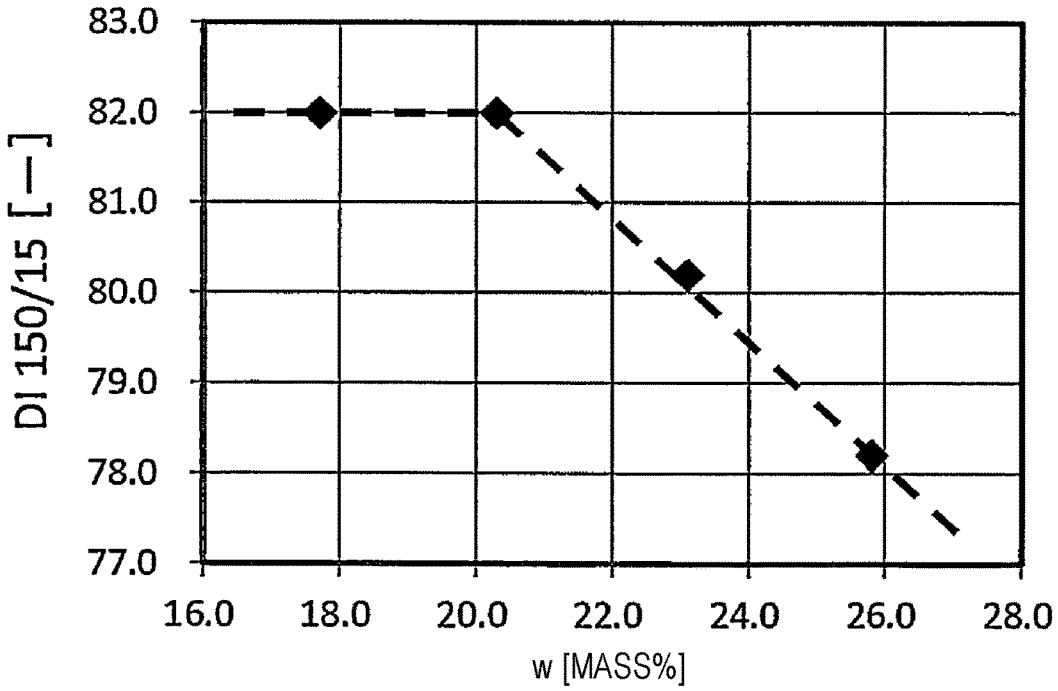
FIG. 2 is a graph showing the relationship between w of coal blends 1 to 4 and the coke strength of cokes produced by carbonizing coal blends 1 to 4.

FIG. 2 is a graph showing the relationship between w of coal blends 1 to 4 and the coke strength of cokes produced by carbonizing coal blends 1 to 4. In FIG. 2, the horizontal axis represents w (mass %), and the vertical axis represents the drum strength (%) of coke. As shown in FIG. 2, coal blend 4 in which w was 17.7 mass % and coal blend 3 in which w was 20.4 mass % had a coke strength of 82.0%, whereas coal blend 2 in which w was 23.1 mass % had a coke strength of 80.2%. Coal blend 1 in which w was 25.8 mass % had a coke strength of 78.2%, which was even lower than that of coal blend 2 in which w was 23.1%.

FIG. 2 reveals that the coke strength does not decrease when w is 20.4 mass % or less, whereas when w is more than 20.4 mass %, the coke strength decreases significantly as w increases. A lower mass fraction of the inert material of the coal outside the surface tension $\gamma_0$ of the reactive material, which is thought to decrease the coke strength, is preferred. For this reason, the lower limit of w is 0 mass %.

Based on these results, in the method of producing a coal blend according to this example, a coal blend is produced by blending brands of coal such that w calculated in the above formula (1) is 20.4 mass % or less. Thereby, the increase of the inert material contained in the coal blend, which reduces coke strength, is prevented, and a coal blend that will be coke having high strength after carbonization can be produced. Then, the coal blend can be charged into a carbonization chamber of a coke oven and carbonized to produce coke having high strength. Typically, the carbonization temperature during coke production may be 900° C. or higher.

The surface tension of coal varies in accordance with the heating temperature during semicoke production. Thus, when the surface tension is measured using semicoke produced by heat-treating coal at 500° C., among coals contained in a coal blend, coal i in which $\gamma_{100}$ of the semicoke is outside of $\gamma_0$ is coal in which $\gamma_{100}$ is less than 37.9 mN/m or more than 42.5 mN/m.

The surface tension of coal increases as the heating temperature during semicoke production increases. Thus, when the heating temperature during semicoke production is increased, both $\gamma_{100}$ and $\gamma_0$ are increased. Thus, the effectiveness of the method of producing a coal blend according to this example was examined at different semicoke preparation temperatures.

Figure 3:
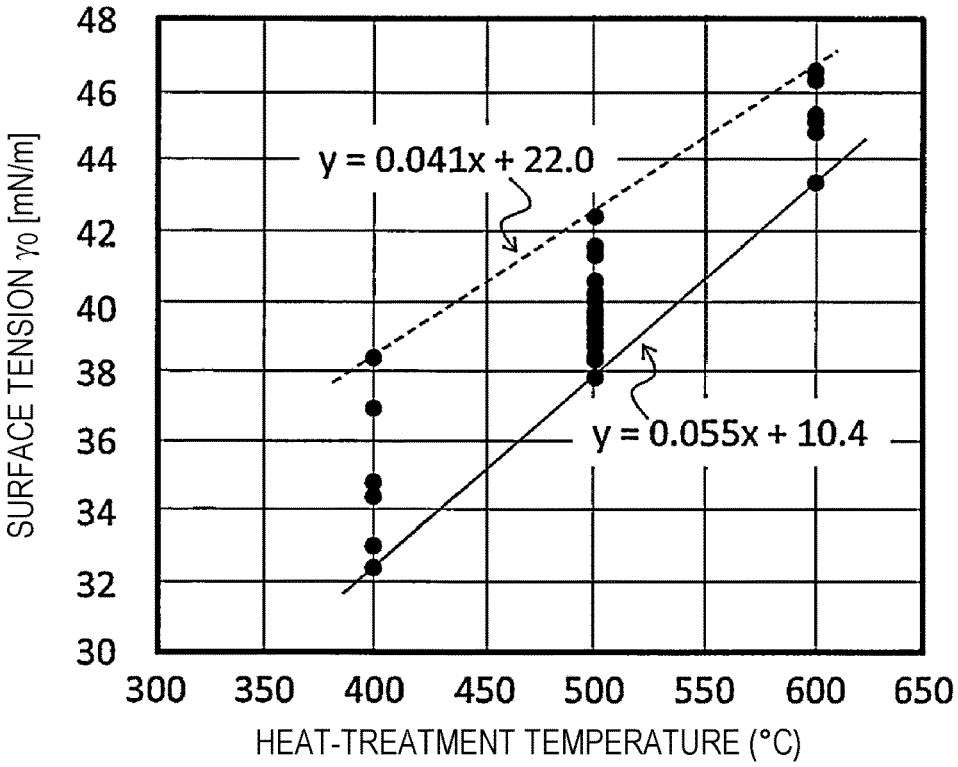
FIG. 3 is a graph showing the relationship between the surface tension $\gamma_0$ when the reactive material of coal is assumed to be 100 vol % and the heat-treatment temperature.

$\gamma_0$ values of various brands of coal were determined using the same method as described above, except that the semicoke preparation temperatures were changed to 400° C. and 600° C. FIG. 3 is a graph showing the relationship between the surface tension $\gamma_0$ when the reactive material of coal is assumed to be 100 vol % and the heat-treatment temperature. In FIG. 3, the horizontal axis represents the heat-treatment temperature (° C.), and the vertical axis represents the surface tension $\gamma_0$ (mN/m). FIG. 3 revealed that the $\gamma_0$ value tended to increase as the semicoke preparation temperature increased. However, even when the semicoke preparation temperature was changed, $\gamma_0$ tended to converge within a certain range as when the semicoke was prepared at 500° C.

Letting the preparation temperature (° C.) of the semicoke be T, a regression line obtained from the minimum values of $\gamma_0$ obtained at the treatment temperatures was $\gamma_0$=0.055 T+10.4 (mN/m). Similarly, a regression line obtained from the maximum values of $\gamma_0$ obtained at the treatment temperatures was $\gamma_0$=0.041 T+22.0 (mN/m). That is, when the preparation temperature of the semicoke is T (° C.), when the surface tension $\gamma_{100}$, which is a surface tension when the inert material of the semicoke is 100%, is less than $\gamma_0$=0.055 T+10.4 (mN/m), which is the minimum value of $\gamma_0$, the coal is coal that decreases the coke strength. Similarly, when the surface tension $\gamma_{100}$, which is a surface tension when the inert material of the semicoke is 100%, is more than $\gamma_0$=0.041 T+22.0 (mN/m), which is the maximum value of $\gamma_0$, the coal is coal that decreases the coke strength.

Figure 4:
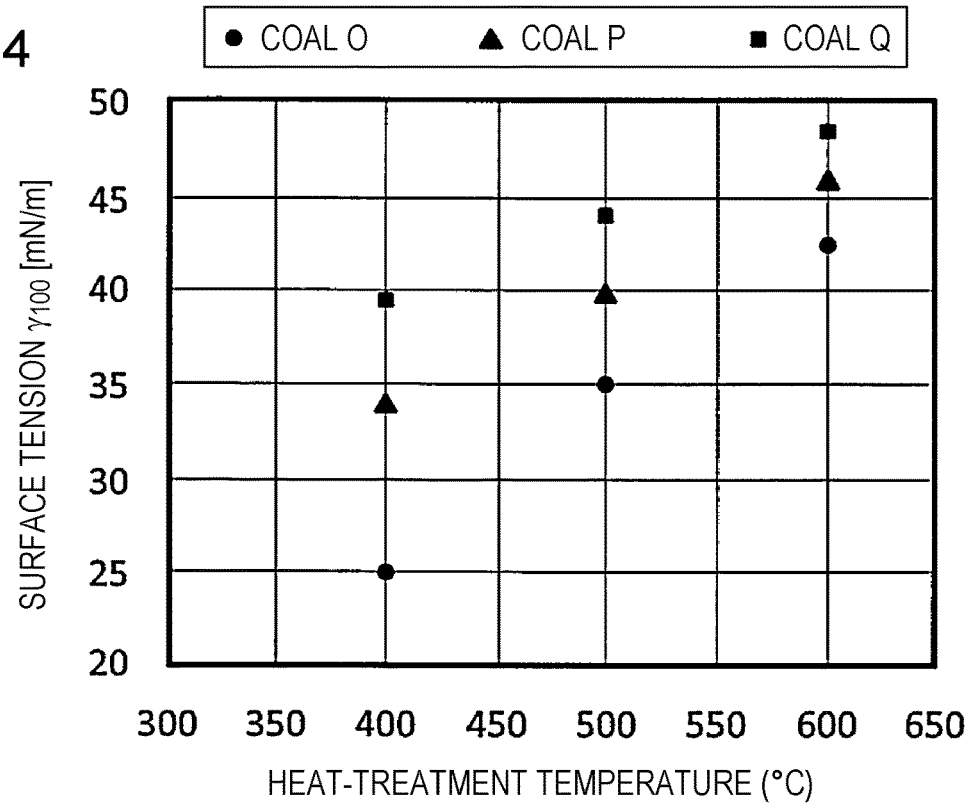
FIG. 4 is a graph showing the relationship between the surface tensions $\gamma_{100}$ of three types of coal that have been heat-treated and the heat-treatment temperature.

FIG. 4 is a graph showing the relationship between the surface tensions $\gamma_{100}$ of three types of coal that have been heat-treated and the heat-treatment temperature. In FIG. 4, the horizontal axis represents the heat-treatment temperature (° C.), and the vertical axis represents the surface tension $\gamma_{100}$ (mN/m). As shown in FIG. 4, $\gamma_{100}$ of coal O was less than $\gamma_0$=0.055 T+10.4 (mN/m), which is the minimum value of $\gamma_0$, at any semicoke preparation temperature of 400° C. to 600° C. Accordingly, coal O is determined to be coal that decreases the coke strength. For coal P, $\gamma_{100}$ fell between the maximum value and the minimum value of $\gamma_0$ at any semicoke preparation temperature of 400° C. to 600° C. Accordingly, coal P is determined to be coal that does not decrease the coke strength. For coal Q, $\gamma_{100}$ was more than $\gamma_0$=0.041 T+22.0 (mN/m), which is the maximum value of $\gamma_0$, at any semicoke preparation temperature of 400° C. to 600° C. Accordingly, coal Q is determined to be coal that decreases the coke strength.

As described above, for various brands of coal, the magnitude relationship between $\gamma_0$ and $\gamma_{100}$ does not change even if the semicoke preparation temperature is changed. Thus, it is understood that the value of 20.4 mass %, which is the preferable upper limit value of w obtained from Table 2 or FIG. 2 based on the value of the semicoke prepared at 500° C., can be used as the upper limit value of the mass fraction of the inert material outside of $\gamma_0$ even at a different semicoke preparation temperature. In the method of producing a coal blend according to this example, the semicoke preparation temperature is preferably 350° C., which is a temperature at which coal starts to soften, to 800° C., which is a temperature at which coking is completed. The semicoke preparation temperature is more preferably 400° C. or higher and 600° C. or lower, which is a temperature at which the possibility of decreasing the coke strength can be clearly determined.

As described above, the $\gamma_0$ of various brands of coal used as raw materials for coke production are determined, and $\gamma_{100}$ of each brand of coal used for production of a coal blend is determined. The brand of coal in which $\gamma_{100}$ is outside of $\gamma_0$ and which decreases the coke strength is specified from $\gamma_0$ to $\gamma_{100}$ of each brand of coal. Then TI of the specified brand of coal that decreases the coke strength is measured. The blending ratio of the coal that decreases the coke strength is determined such that the ratio of the inert material is less than or equal to the upper limit value. It is thus possible to produce a coal blend that will be coke having high strength after carbonization. Carbonization of the coal blend produced in this way enables the production of high-strength coke.

In the method of producing a coal blend according to this example, an example in which the surface tension of semicoke prepared by heat-treating coal is used has been described. However, our methods are not limited thereto. The surface tension of coal that has not been heat-treated may be used. As described above, the film flotation method can be similarly employed to coal and semicoke obtained from the coal, and the surface tension can be measured. Moreover, $\gamma_0$ and $\gamma_{100}$ may be obtained from a coal sample by measuring the surface tension, or may be obtained by estimation from some coal physical properties. A value provided by another person may be used as the measured or estimated value. $\gamma_0$ can also be determined within the minimum value $\gamma_0$=0.055 T+10.4 (mN/m) to the maximum value $\gamma_0$=0.041 T+22.0 (mN/m), where T (° C.) is the semicoke preparation temperature.

The invention claimed is:

1. A method of producing a coal blend by blending plural brands of coal to produce a coal blend, the method comprising:

where $\gamma_{100}$ is a surface tension of coal having 100% inert material, and where $\gamma_0$ is a surface tension of coal having 100% reactive material, determining a range of $\gamma_0$ for each of the plural brands of coal;

among brands of coal 1, 2, . . . i, . . . , and n to be blended in a coal blend, identifying each coal i in which $\gamma_{100}$ is outside-of the range of $\gamma_0$;

measuring TI of coal i, wherein TI is a total inert material specified in JIS M 8816 and indicates the proportion (vol %) of inert material contained in coal i;

determining a blending ratio of coal i such that w calculated by formula (1) is 20.4 mass % or less, $$w=\Sigma(xi\times TIi) \quad (1)$$

wherein xi is the blending ratio (mass %) of coal i, TIi is a fraction (vol %) of the inert material contained in coal i, and w is the mass fraction (mass %) of the inert material of the coal different than $\gamma_0$ in the coal blend;

forming the coal blend by blending the plural coals based on the determined blending ratio; and producing coke by carbonizing the coal blend, wherein the produced coke has higher strength compared with coke not blended by the determined blending ratio.

2. The method according to claim 1, wherein, when the surface tension is measured using semicoke produced by heat-treating coal at a temperature T° C. of 350° C. to 800° C., $\gamma_0$ of each of the plural brands of coal is (0.055T+10.4) mN/m or more and (0.041T+22.0) mN/m or less.

3. The method according to claim 1, wherein, when the surface tension is measured using semicoke produced by heat-treating coal at 500° C., $\gamma_0$ of each of the plural brands of coal is 37.9 mN/m or more and 42.5 mN/m or less.

4. A method for producing a coal blend by blending plural brands of coal to produce a coal blend, the method comprising:

where $\gamma_{100}$ is a surface tension of coal assumed to have 100 vol % inert material;

and where $\gamma_0$ is a surface tension of coal assumed to be 100 vol % reactive material, determining a range of $\gamma_0$ of the plural brands of coal;

identifying among brands of coal 1, 2, . . . i, . . . , and n to be blended in a coal blend, those coals in which $\gamma_{100}$ is outside the range of $\gamma_0$;

measuring TI of coal i, wherein TI is a total inert material specified in JIS M 8816 and indicate the proportion (vol %) of inert material contained in coal; and determining a blending ratio of coal i in such a manner that w calculated by formula (1) below is 20.4 mass % or less, $$w=\Sigma(xi\times TIi) \quad (1)$$

where in formula (1), xi is the blending ratio (mass %) of coal i, TIi is a fraction (vol %) of the inert contained in coal i, and w is the mass fraction (mass %) of the inert material of the coals having $\gamma_{100}$ outside the range of $\gamma_0$ in the coal blend;

forming the coal blend by blending the plural coals based on the determined blending ratio; and producing coke by carbonizing the coal blend, wherein the produced coke has higher strength compared with coke not blended by the determined blending ratio.

5. A method of producing a coal blend from plural brands of coal, the method comprising:

for each brand of coal, knowing $\gamma_0$ and $\gamma_{100}$, where $\gamma_0$ is a surface tension of coal having 100% reactive material; and where $\gamma_{100}$ is a surface tension of coal having 100% inert material;

determining a range of $\gamma_0$ across the plural brands of coal;

identifying which brands of coal have $\gamma_{100}$ outside the range of $\gamma_0$ for the plural brands of coal, measuring TI of coal i, wherein TI is a total inert material specified in JIS M 8816 and indicate the proportion (vol %) of inert material contained in coal;

providing a predetermined value for a desired mass fraction of inert material;

calculating the mass fraction of inert material (w, mass %) as the sum of each identified brand of coal's blending ratio (x) times the fraction (vol %) of inert material contained in that brand of coal, according to the following formula:

$$w=\Sigma(x*TI)$$

blending plural brands of coal to produce a coal blend, having a calculated mass fraction of inert material (w, mass %) below the predetermined value for a desired mass fraction of inert material; and producing coke by carbonizing the coal blend, wherein the produced coke has higher strength compared with coke not blended by the determined blending ratio.

6. The method of claim 5, wherein the surface tension is measured using semicoke produced by heat-treating coal at a temperature T where the range of $\gamma_0$ is calculated as between (0.055T+10.4) mN/m and (0.041*T+22.0) mN/m.

7. The method of claim 6, wherein T is from 350 C to 800 C.

8. The method of claim 5, wherein the predetermined value of w is 20.4 mass %.

* * * * *